United States Patent [19]

Tellman

[11] 4,188,762

[45] Feb. 19, 1980

[54] TRIPLE LAP HARDBOARD SIDING

[75] Inventor: Stephen J. Tellman, Patterson, N.Y.

[73] Assignee: Champion International Corporation, Stamford, Conn.

[21] Appl. No.: 915,372

[22] Filed: Jun. 14, 1978

[51] Int. Cl.[2] ..... E04D 3/18

[52] U.S. Cl. ..... 52/541; 52/314; 52/558

[58] Field of Search ..... 52/541, 555, 558, 314, 52/316, 539

[56] References Cited

U.S. PATENT DOCUMENTS

| | | | |
|---|---|---|---|
| 294,855 | 3/1884 | Crawford | 52/539 |
| 440,187 | 6/1890 | Kendall | 52/541 |
| 494,543 | 4/1893 | Betts | 52/609 |
| 1,171,081 | 2/1916 | Aycock | 52/314 |
| 1,545,212 | 7/1925 | Stowe | 52/541 |
| 2,037,507 | 4/1936 | Fischer | 52/558 |
| 2,130,911 | 9/1938 | Teunon | 52/386 X |

FOREIGN PATENT DOCUMENTS

| | | | |
|---|---|---|---|
| 1103143 | 5/1955 | France | 52/316 |

*Primary Examiner*—Alfred C. Perham
*Attorney, Agent, or Firm*—Evelyn M. Sommer

[57] ABSTRACT

A triple lap siding product is machined from a strip of wide lap hardboard siding to give the appearance of three narrow laps of natural wood siding or actual drop siding cut from ¾" lumber. The configuration for simulating narrow lap siding is machined with beveled profiles having opposed first and second surfaces. Each strip of siding includes a plurality of inclined cuts and vertical cuts subdividing the single strip into three lap portions. The configuration for simulating actual drop siding includes a plurality of arcuate cuts and vertical cuts that subdivide each strip of siding into three lap portions. For both types of siding, the leading edge of one strip is adapted to cooperate with the trailing edge of another strip to form a continuous lap siding installation on the building or the like.

3 Claims, 4 Drawing Figures

TRIPLE LAP HARDBOARD SIDING

BACKGROUND OF THE INVENTION

The subject invention relates to articles of manufacture used in the construction industry, and more particularly to a new and improved lap siding construction. Lap siding is becoming more and more popular, particularly in the narrow widths which are characteristic of the siding traditionally used on old colonial homes. In the past, lap siding has been made generally of solid wood, but, this is undesirable in that it is difficult to obtain in clear grades. In addition, in recent years the costs associated with solid wood siding have become increasingly higher. These factors have contributed to a rising demand for hardboard lap siding which is significantly lower in cost than solid wood, and yet is substantially on a par to wood siding in appearance and performance. Unfortunately, hardboard lap siding is commonly available only in 8" and 12" widths. Lesser width lap siding, such as for example, siding having a width of 6" must be obtained on a special order at a substantially higher price. Such narrow width lap siding also requires significantly more labor to install because there is less coverage per lap. It will be appreciated that the greater the labor, the higher the installed costs involved. These factors make narrow lap siding unpopular with builders despite the fact that the end product is generally found to be more aesthetically pleasing, than wide lap siding.

Accordingly, it is an object of the subject invention to provide hardboard lap siding which, while being machined from standard 12" wide hardboard strips, will give the appearance and performance of narrow lap siding.

It is another object of the subject invention to provide hardboard lap siding as described above having the labor saving advantages of wide lap siding.

It is a further object of the subject invention to provide a hardboard lap siding described above which is comparatively less expensive to manufacture than conventional narrow lap hardboard siding.

SUMMARY OF THE INVENTION

In accordance with the above recited objectives, one embodiment of the subject invention comprises the machining of standard wide lap hardboard siding having the nominal dimensions of 12" wide, 7/16" thickness and 16 foot length to give the appearance of narrow multi-lap siding. The subject strip of hardboard has first and second opposed surfaces, a trailing edge, and a leading edge. The subject strip also includes a plurality of inclined and vertical cuts which subdivide the strip into three lap portions. More particularly, the subject strip includes a first inclined cut extending along the first surface of the strip from the trailing edge thereof, and terminating at a point intermediate the thickness of the strip. The subject strip also includes a vertical cut extending from the termination point of said first inclined cut to the first surface of the strip to form a first vertical wall member. The subject strip also further includes a second inclined cut extending from said first vertical cut portion and terminating at a point intermediate the width of the strip at a point intermediate the thickness of the strip. The second cut has substantially the same width as the first inclined cut. A second vertical cut extends from the terminating point of said inclined cut to the first surface of the hardboard strip, thus forming a second vertical wall member. A third inclined cut extends from the terminating point of said second vertical cut and extends to a point intermediate the thickness of the strip. The width of the third inclined cut is substantially equal to that of the first and second inclined cuts. A horizontal cut extends from the terminating point of the third inclined cut to the free edge of the strip to form the leading edge of the hardboard strip. The second surface of the subject strip is flat for substantially the entire width of the strip. At the trailing portion thereof, however, there is a substantially rectangular cut portion extending from said second surface to a point intermediate the thickness of the strip. The thickness of the strip at the leading edge thereof is substantially equal to the thickness of the cut portion at the trailing edge thereof, such that the leading edge of one strip of lap siding cooperates with the trailing edge of another to achieve the appearance of continuous narrow lap siding.

In another embodiment of the subject invention, the subject strip of hardboard includes a plurality of arcuate cuts and vertical cuts which subdivide the strip into three lap portions, a trailing edge, and a leading edge. More particularly, the alternate embodiment of the subject strip of siding includes a first flat portion extending from the trailing edge of the strip and terminating at a point intermediate the width of the strip. A first arcuate cut extends from the terminating point of said first flat portion and terminates at a point intermediate the thickness of the strip. A vertical cut extends from the terminating point of said first arcuate cut and terminates at the first surface of the strip to form a first vertical wall portion. The strip further includes a second flat portion which extends from the terminating point of said first vertical cut along said first surface of the strip and terminates at a point intermediate the width of the strip. The width of the second flat portion is substantially equal to that of the first flat portion. A second arcuate cut extends from the terminating point of said second flat portion and terminates at a point intermediate the thickness of the strip. A second vertical cut extends from the terminating point of said second arcuate cut to the first surface of the strip, thus forming a second vertical wall portion. A third flat portion extends from the terminating point of said second vertical cut and terminates at a point intermediate the width of the strip. The width of said third flat portion is substantially equal to that of said first and second flat portions. A third arcuate cut extends from the terminating point of said third flat portion to a point intermediate the thickness of the strip. The strip of hardboard then includes a substantially horizontal cut which extends from the terminating point of said third arcuate cut to the free edge of the strip, thus forming the leading edge of the panel. The second surface of the subject strip is flat for substantially the entire width of the strip except for the trailing portion thereof. The latter includes a substantially rectangular cut portion which extends from said second surface to a point intermediate the thickness of the strip. The thickness of the leading edge of the strip is substantially equal to the thickness of the cut portion of the trailing edge thereof such that the leading edge of one strip cooperates with the trailing edge of another to form a continuous lap siding.

DETAILED DESCRIPTION OF THE PREFERRED EMBODIMENTS

Figure 1:
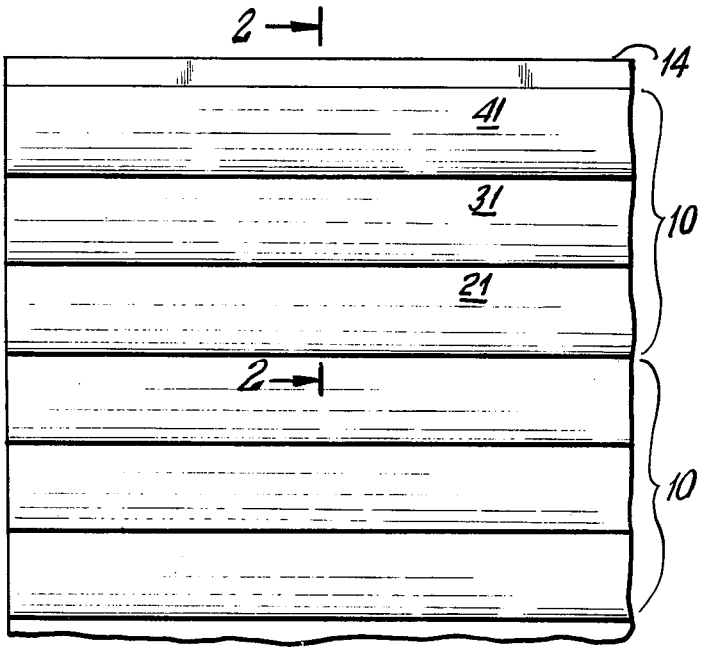
FIG. 1 is a partial plan view of one embodiment of the subject triple lap hardboard siding.
Figure 2:
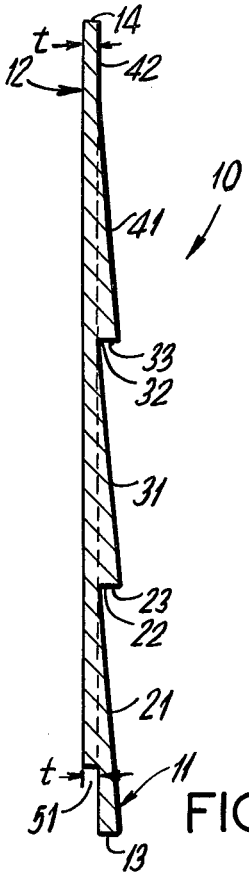
FIG. 2 is a cross-sectional view of the triple lap hardboard siding of the subject invention taken along line 2—2 of FIG. 1.

Referring to FIGS. 1 and 2, there is illustrated one embodiment of the triple lap hardboard siding of the subject invention. More particularly, FIGS. 1 and 2 illustrate a beveled siding configuration which approximates the look of conventional natural wood narrow lap siding. It will be noted that FIG. 2 represents a somewhat enlarged cross sectional view of a portion of FIG. 1, FIG. 2 comprising in itself a single strip of siding. It will be appreciated that two strips of siding have been combined in FIG. 1 to give the continuous lap board appearance.

Further referring to FIGS. 1 and 2, the strip of hardboard siding which comprises the unit member of the triple lap siding of the subject invention is designated generally by reference numeral 10. Strip 10 is typically a commonly available hardboard lap siding having the nominal dimensions of 12" width, 7/16" thickness, and 16 feet length. It will be appreciated that other commonly available size laps may also be used. The strips of hardboard lap siding are machined to give them the specific configuration illustrated in FIGS. 1 and 2, said configuration to be described in detail below.

Referring to FIG. 2, the hardboard strip 10 has opposed front and back surfaces, 11 and 12 respectively, front surface 11 being machined with a plurality of cut portions to provide the desired aesthetic effect. More particularly, strip 10 includes a first inclined cut which extends from trailing edge 13 of the strip and terminates at a point intermediate the width thereof. In addition, inclined cut 21 penetrates the strip to a point intermediate the thickness thereof. The strip further includes a first vertical cut 22 which extends from the termination of first inclined cut 21 and extends to a point of maximum thickness of the strip, thus forming a first vertical wall 23. A second inclined cut 31 extends from vertical wall 23 and terminates at a point intermediate the width of the strip. Inclined cut 31 preferably has a width substantially equal to that of inclined cut 21. In addition, inclined cut 31 preferably penetrates the thickness of the strip at substantially the same angle as inclined cut 21. A second vertical cut 32 extends from the terminating point of inclined cut 31 and extends to a point of maximum thickness of the strip, thus forming a second vertical wall 33. A third inclined cut 41 extends from second vertical wall 33 and terminates at a point intermediate the width of the strip, the width of inclined cut 41 being substantially equal to that of inclined cuts 31 and 21. In addition, inclined cut 41 preferably penetrates the strip at substantially the same angle as cuts 31 and 21. A flat cut 42 extends from the termination of inclined cut 41 and extends to the leading edge of the strip 14. It will be noted that the leading edge of the strip has a thickness "t". In addition, it will be noted that at trailing edge 13 of the subject strip, the back surface 12 thereof includes a substantially rectangular cut 51 which has a thickness substantially equal to the thickness "t" of the leading edge 14 of the strip. Thus, in constructing the subject siding, the leading edge of one strip of hardboard fits into the trailing edge of another strip to form a continuous siding surface.

Figure 3:
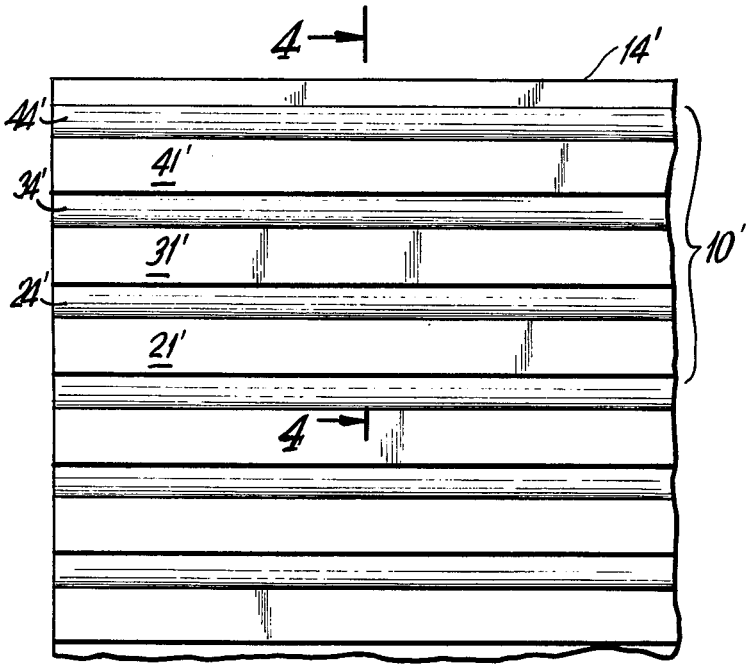
FIG. 3 is a partial plan view of an alternate embodiment of the triple lap hardboard siding of the subject invention.
Figure 4:
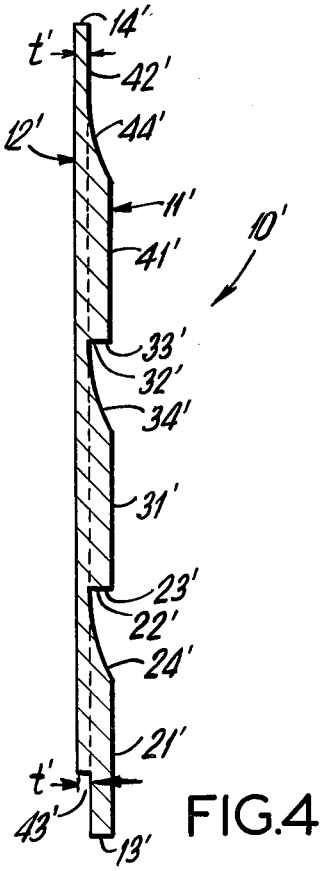
FIG. 4 is a cross-sectional view of the alternate embodiment of the triple lap hardboard siding of the subject invention taken along line 4—4 of FIG. 3.

Referring now to FIGS. 3 and 4, there is illustrated another embodiment of the triple lap hardboard siding configuration of the subject invention. More particularly, FIGS. 3 and 4 illustrate a hardboard strip having a drop siding configuration which substantially approximates the aesthetics and performance of actual drop siding cut from ¾" thick natural lumber. It will be noted that FIG. 4 comprises a somewhat enlarged sectional view of a portion of the siding illustrated in FIG. 3, FIG. 4 comprising a single unit three-lap configuration of the subject invention.

Turning now specifically to FIG. 4, the subject strip of hardboard 10' includes first and second opposed front and back surfaces, 11' and 12', respectively, front surface 11' including a plurality of cuts for providing the desired aesthetic affect. More particularly, the subject strip includes a first flat surface 21' which extends along surface 11' from the trailing edge 13' of the strip to a point intermediate the width thereof. A first arcuate cut portion 24' extends from the termination of first flat portion 21' and penetrates the strip to a point intermediate the thickness thereof. In a typical 12" wide hardboard strip the arcuate cut 24' may have a radius of approximately 2" to 2⅜". A vertical cut portion 22" extends from the termination of arcuate cut 24' and terminates at surface 11' of the strip to form a vertical wall 23'. A second flat portion 31' extends from vertical wall 23' along surface 11' of the strip and terminates at a point intermediate the width thereof. Preferably, the width of flat portion 31' is essentially equal to that of flat portion 21'. A second arcuate 34" cut extends from the termination of flat portion 31' and penetrates the strip to a point intermediate the thickness thereof. Preferably, the radius of arcuate cut 34' approximates that of arcuate cut 24'. A second vertical cut portion 32' extends from the termination of arcuate cut 34' and terminates at surface 11' of the strip to form a vertical wall 33'. A third flat portion 41' extends from vertical wall 33' and terminates at a point intermediate the width of the strip. Preferably, the width of flat portion 41' is substantially equal to that of flat portions 31' and 21'. A third arcuate cut 44' extends from the termination of flat portion 41' and penetrates the strip at a point intermediate the thickness thereof. Preferably, the radius of arcuate cut 44' is substantially equal to that of arcuate cuts 34' and 24'. A flat cut portion 42' extends from the termination of arcuate cut 44' to the leading edge 14' of the panel. The thickness of the strip at the leading edge thereof is "t'". The back surface of the strip 12' is flat for substantially the entire width of the strip. However, at the trailing edge of the strip 13' there is a substantially rectangular cutout 43' which preferably has a thickness "t'". Thus, the leading edge of one strip cooperates with the trailing edge of another strip to form one continuous siding appearance.

As indicated above, the subject strips of hardboard siding are machined to provide the desired aesthetic effect. It will be appreciated that in addition to plain hardboard, the subject strips may be constructed from emboss textured hardboard. In addition, if desired, the whole triple lap profile may be molded into the hardboard during the board-making process by the use of textured caul plates.

In summary, the subject invention provides new and improved multiple lap siding which is preferably constructed from standard size strips of hardboard which are generally used to make wide lap siding and are machined to give the impression of being narrow lap siding constructed from natural lumber. This siding has the advantage of permitting the use of ¾" thick trim boards as opposed to the 5/4" thick boards required with conventional lumber and hardboard lap sidings. This represents approximately a 40% savings in wood trim and a significant reduction in cost to the builder. In addition, because the subject siding is made from hardboard there is a substantial saving in cost as compared with siding made from solid wood, vinyl or aluminum. The subject invention also provides a significant reduction in installation costs over conventional lap siding. Specifically, the subject strips of hardboard enable three "laps" to be installed with each unit strip (typically a 12" wide strip). Also, because each standard strip is typically 16 feet long there is generally less cutting and fitting. In addition, because there is only one overlap required for every three "laps" of siding, there is less material required to cover a given area of wall space. This increases coverage by as much as 20% over conventional narrow lap configurations which require an overlap at every course. Increased coverage also provides the advantage of lower weight per unit area covered when compared to conventional hardboard lap siding. The latter feature is particularly advantageus in mobile home installations where weight is critical.

While there have been described herein what are at present considered preferred embodiments of the invention, it will be obvious to those skilled in the art that many mofifications and changes may be made therein without departing from the essence of the invention. For example, based on the width of the siding, either two or a greater number than three laps may be formed in the siding to likewise result in the beneficial features of the invention as more fully set forth above. It is therefore to be understood that the exemplary embodiments are illustrative and not restrictive of the invention, the scope of which is defined in the appended claims, and that all modifications that come within the meaning and range of equivalency of the claims are intended to be included therein.

What is claimed is:

1. A triple lap hardboard siding formed from a single, elongated strip of hardboard material of a thickness of approximately 7/16 of an inch and a width of approximately 12 inches, said siding having front and back opposed surfaces, a leading edge and a trailing edge, respectively disposed at opposite ends of the width of the strip, said siding including a first flat surface extending parallel to the back surface from the trailing edge of the siding and terminating at a point intermediate the width of the strip; a first arcuate cut portion extending from the terminating point of said first flat portion and penetrating the strip to a point intermediate the thickness thereof; a first vertical cut portion extending perpendicular to said back surface from the terminating point of said first arcuate cut and terminating at the front surface of the strip to form a first vertical wall member; a second flat portion extending parallel to the back surface from said first vertical wall member and terminating at a point intermediate the width of the strip, the width of said second flat portion being substantially equal to that of said first flat portion; a second arcuate cut portion extending from the terminating point of said second flat portion and penetrating the strip to a point intermediate the thickness thereof; a second vertical cut portion extending perpendicular to said back surface from the termination of said second arcuate cut and terminating at the front surface of the strip to form a second vertical portion; a third flat portion extending parallel to said back surface from said second vertical wall member and terminating at a point intermediate the width of the strip, said third flat portion having substantially the same width as said second and first flat portions; a third arcuate cut extending from the termination of said third flat portion and penetrating the strip to a point intermediate the thickness thereof; a flat cut portion extending from the termination of said third arcuate cut to the leading edge of said strip, said flat cut portion being parallel to said back surface and being of a length of at least ¾ inch; said first, second and third arcuate cuts each having a radius of approximately 2" to 2⅜", such that the third arcuate cut fairs into the flat cut portion, said first, second and third arcuate cuts each penetrating said strip at approximately the same thickness level; said back surface of the strip including a substantially rectangular cut portion at the trailing edge of the strip, the thickness of said rectangular cut portion being substantially the same as the thickness of the strip between said back surface and said flat cut portion at the leading edge thereof, and with the width of said rectangular cut portion being substantially the same as the width of said flat cut portion which extends from the termination of said third arcuate cut to the leading edge of said strip, such that the leading edge of one strip of hardboard siding cooperates with the trailing edge of another strip of hardboard siding to form a continuous siding installation.

2. A triple lap hardboard siding as in claim 1 in which said front surface is embossed.

3. A triple lap hardboard siding as in claim 1 in which the front surface has a molded lap profile.

* * * * *